US006746223B2

(12) United States Patent
Manole

(10) Patent No.: US 6,746,223 B2
(45) Date of Patent: Jun. 8, 2004

(54) ORBITING ROTARY COMPRESSOR

(75) Inventor: Dan M. Manole, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/329,910

(22) Filed: Dec. 26, 2002

(65) Prior Publication Data

US 2003/0147762 A1 Aug. 7, 2003

Related U.S. Application Data

(60) Provisional application No. 60/344,176, filed on Dec. 27, 2001.

(51) Int. Cl.[7] ..... F04C 18/00

(52) U.S. Cl. ..... 418/55.1; 418/55.3; 418/183; 418/188

(58) Field of Search ..... 418/55.1, 183, 418/188, 55.3; 464/102

(56) References Cited

U.S. PATENT DOCUMENTS

| | | | | | |
|---|---|---|---|---|---|
| 1,370,864 | A | * | 3/1921 | Emile | 464/102 |
| 1,906,142 | A | * | 4/1933 | Ekelof | 418/59 |
| 2,423,507 | A | | 7/1947 | Lawton | |
| 2,695,597 | A | | 11/1954 | Griffiths | |
| 2,759,664 | A | | 8/1956 | Auwarter | |
| 3,572,985 | A | | 3/1971 | Runge | |
| 3,909,161 | A | | 9/1975 | Stenner | |
| 4,005,951 | A | | 2/1977 | Swinkels | |
| RE29,230 | E | | 5/1977 | Sarich | |
| 4,086,039 | A | | 4/1978 | Ettridge | |
| 4,274,374 | A | | 6/1981 | Lee | |
| 5,006,052 | A | | 4/1991 | Kazaoka et al. | |
| 5,015,161 | A | | 5/1991 | Amin et al. | |
| 5,066,206 | A | * | 11/1991 | Kakuda et al. | 418/55.3 |
| 5,135,368 | A | | 8/1992 | Amin et al. | |
| 5,240,386 | A | | 8/1993 | Amin et al. | |
| 5,284,426 | A | | 2/1994 | Strikis et al. | |
| 5,302,095 | A | | 4/1994 | Richardson, Jr. | |
| 5,370,511 | A | | 12/1994 | Strikis et al. | |
| 5,375,985 | A | | 12/1994 | Pipaloff | |
| 5,383,773 | A | | 1/1995 | Richardson, Jr. | |
| 5,399,076 | A | | 3/1995 | Matsuda et al. | |
| 5,472,327 | A | | 12/1995 | Strikis et al. | |
| 5,597,295 | A | | 1/1997 | Pipaloff | |
| 5,855,474 | A | | 1/1999 | Shouman | |
| 5,871,342 | A | | 2/1999 | Harte et al. | |
| 6,079,952 | A | | 6/2000 | Harte et al. | |
| 6,089,830 | A | | 7/2000 | Harte et al. | |
| 6,093,005 | A | * | 7/2000 | Nakamura | 418/55.1 |
| 6,099,279 | A | | 8/2000 | Koshokabe et al. | |
| 6,152,714 | A | | 11/2000 | Mitsuya et al. | |
| 6,164,941 | A | | 12/2000 | Koshokabe et al. | |
| 6,179,593 | B1 | | 1/2001 | Mitsuya et al. | |
| 6,203,301 | B1 | | 3/2001 | Kim | |
| 6,217,303 | B1 | | 4/2001 | Koshokabe et al. | |

FOREIGN PATENT DOCUMENTS

| | | | | |
|---|---|---|---|---|
| DE | 917 744 | | 9/1954 | |
| DE | 95 36 714 | | 4/1986 | |
| JP | 02227579 A | * | 9/1990 | F04C/18/02 |
| JP | 04121477 A | * | 4/1992 | F04C/18/02 |

* cited by examiner

*Primary Examiner*—Thomas Denion
*Assistant Examiner*—Theresa Trieu
(74) *Attorney, Agent, or Firm*—Baker & Daniels

(57) ABSTRACT

An orbiting rotary compressor assembly having a compression mechanism disposed in a housing and including relatively moving fixed and orbiting compression members including extending portions having surfaces engaged with each other and between which a compression chamber is located. The orbiting member has a centrally-located hub which moves eccentrically relative to the axis of rotation of a drive shaft in driving engagement with the hub. A vane operatively engages the fixed member extending portion and the orbiting member extending portion, and partially defines the compression chamber. An Oldham coupling is disposed about and is in engagement with the hub, and is in engagement with the fixed compression member, rotation of the orbiting compression member being prevented by the Oldham coupling.

20 Claims, 9 Drawing Sheets

0°

60°

120°

180°

240°

300°

ORBITING ROTARY COMPRESSOR

This application is related to and claims the benefit under 35 U.S.C. §119(e) of U.S. Provisional Application No. 60/344,176 filed Dec. 27, 2001.

BACKGROUND OF THE INVENTION

An orbiting rotary compressor has similarities to both a scroll compressor and a rotary compressor. The similarities to a scroll compressor include multiple compression chambers defined by a driven member which has orbiting motion relative to a fixed member to which it is engaged. The similarities to a rotary compressor include a compression chamber defined between the outer cylindrical surface of a roller or piston, the inner cylindrical surface of a compressor block about which the piston moves epicyclically, and a vane extending between these cylindrical surfaces.

In general, orbiting rotary compressors include a fixed compression member and a moving compression member engaged therewith. The fixed and moving compression members typically include planar bases and circumferentially-engaged cylindrical surfaces which extend perpendicularly from the bases. When the fixed and orbiting compression members are assembled relative to one another, the cylindrical surfaces define a space therebetween which is a compression chamber. A single cylinder orbiting rotary compressor is one having a single pair of engaged fixed and orbiting compression member cylindrical surfaces, whereas a multiple cylinder orbiting rotary compressor is one having a plurality of pairs of engaged fixed and orbiting compression member cylindrical surfaces. In the latter case, the fixed compression member may be provided with an inner cylindrical surface and an outer cylindrical surface between which a portion of the orbiting compression member defined by concentric inner and outer cylindrical surfaces is located. In either case, compression chambers are defined by the cooperating fixed and orbiting compression member surfaces and a vane extending therebetween.

An example of a twin compression chamber rotary type compressor is disclosed by U.S. Pat. No. 5,399,076 to Matsuda et al. With reference to its drawings, a fixed compression member includes a base from which a cylindrical post perpendicularly extends to define a fixed inner cylindrical surface. A moving compression member or rolling piston having an extending portion defined by concentric cylindrical surfaces is positioned with its inner cylindrical surface disposed about the post to define, with a first reciprocating vane, a first, inner compression chamber. The fixed and moving compression members are encased by a housing which has a cylindrical surface surrounding the extending portion of the moving compression member to define, with a second reciprocating vane, a second, outer compression chamber. Each compression chamber is provided with a suction or inlet port and a discharge or outlet port, each discharge port being provided with a check valve to prevent reentry of compressed refrigerant into the compression chamber.

The first reciprocating vane is mounted in a slot provided in the post and the second reciprocating vane is mounted in a slot provided in the housing, to respectively divide the inner and outer compression chambers into sub-chambers when the respective vane is not completely disposed within its slot. The first and second vanes are arranged relative to one another such that the timing of the commencement of the compression processes in the inner and outer compression chambers are 180 degrees out of phase.

With reference to FIG. 5(*a*) of Matsuda et al. '076, when the moving compression member cylindrical portion has a position of zero degrees, the first vane is fully extended from its slot and the inner compression chamber is midway through the compression process, with compressed refrigerant being discharged from one compression sub-chamber and suction pressure gas being drawn into the second compression sub-chamber. Here, the outer compression chamber is filled with gas substantially at suction pressure and ready be compressed; the second vane of the outer compression chamber is fully depressed into its slot, and the moving compression member cylindrical portion covers both the suction and discharge ports of the outer compression chamber. By covering the ports of the outer compression chamber at the commencement of the compression process, leakage of refrigerant from the outer compression chamber is prevented.

As the moving compression member cylindrical portion moves to a position of 180 degrees (FIG. 5(*c*)), the outer compression chamber is midway through the compression process. Here, one of its sub-chambers contains compressed refrigerant which is being discharged through the discharge port, and its other sub-chamber is being filled with suction pressure gas through the suction port. The first vane of the inner compression chamber is now depressed into the slot in the fixed compression member post. The inner compression chamber is now filled with suction pressure gas and its compression process begins. In this position, the orbiting compression member cylindrical portion covers the inlet and outlet ports of the inner compression chamber to prevent fluid leakage.

A potential problem with some previous rotary compressors is that sliding engagement of the moving compression member relative to tip of the vane may wear the vane tip and/or place undesirable shear or bending stresses on the vane. Thus, it may be desirable to prevent rotation of the moving compression member.

Some previous rotary compressors limit rotation of the moving compression member in a manner similar to that used to prevent rotation of the orbiting scroll member in scroll compressors. Previous orbiting rotary compressors may utilize an Oldham coupling between the planar base of the moving or orbiting compression member and the main bearing of the compressor, which is disposed between the compression mechanism and the electric motor within the hermetic shell. Examples of such orbiting rotary compressors are disclosed in U.S. Pat. Nos. 5,302,095 and 5,383,773 to Richardson, Jr. Accommodating the Oldham coupling between the main bearing and Oldham coupling in previous orbiting rotary compressors has resulted in the fixed compression member and main bearing being separate components which must be assembled together, which may be undesirable.

Additionally, some other previous orbiting rotary compressors have relied on an outboard bearing or a fixed compression mechanism plate member located on the axial side of the compression chamber opposite the fixed compression member to define and seal the compression chamber, an axial end of the orbiting compression member in sliding abutting engagement with the interfacing planar surface of this bearing or plate member. U.S. Pat. No. 6,152,714 to Mitsuya et al. discloses an example of such a compressor. Reducing the number of separate components which define the sealed compression chamber(s) is desirable, as would be an orbiting rotary compressor having an orbiting compression member with an base integral with that member's cylindrical surface(s).

Moreover, previous orbiting rotary compressors often rely on springs to bias the vane(s) against the moving compression member. Assembly of the compressor is often complicated by including parts such as these small springs. It may be desirable to exclude them where possible to simplify assembly.

SUMMARY OF THE INVENTION

The present invention addresses several of the above-identified shortcomings of previous orbiting rotary compressors, and provides advantages associated with each of the above-identified desirable features.

Generally, the present invention includes compressor embodiments having a fixed compression member having integral, compression chamber-defining cylindrical surface (s), and which also provides a main bearing, and an orbiting member which is provided with integral base and compression chamber-defining cylindrical surface(s). Such a compressor may have a single compression chamber advantageously having a vane which does not require a spring to bias it into sealing engagement with the orbiting compression member, or a compressor having plurality of compression chambers, each having a vane, wherein at least one vane also advantageously does not require a biasing spring. An Oldham coupling for such a compressor may be either engaged with the orbiting and fixed compression members, or with the orbiting compression member and an outboard bearing.

Certain embodiments of the present invention provide an orbiting rotary compressor assembly having a compression mechanism disposed in a housing and including relatively moving fixed and orbiting compression members including extending portions having surfaces engaged with each other and between which a compression chamber is located. The orbiting member has a centrally-located hub which moves eccentrically relative to the axis of rotation of a drive shaft in driving engagement with the hub. A vane operatively engages the fixed member extending portion and the orbiting member extending portion, and partially defines the compression chamber. An Oldham coupling is disposed about and is in engagement with the hub, and is in engagement with the fixed compression member, rotation of the orbiting compression member being prevented by the Oldham coupling.

Certain embodiments of the present invention provide an orbiting rotary compressor assembly in which a compression mechanism is disposed in a housing and includes relatively moving fixed and orbiting compression members, and an outboard bearing which is fixed to the fixed compression member and supports the orbiting compression member. The compression members each have a base from which an extending portion extends, these extending portions having surfaces engaged with each other and between which a compression chamber is located. The orbiting member further has a centrally-located hub extending from its base. A rotating drive shaft having an axis of rotation is in driving engagement with the orbiting compression member hub, and the hub has eccentric movement relative to the axis of rotation. A vane operatively engages the fixed and orbiting member extending portions and partially defines the compression chamber. The hub and the fixed compression member form a first pair of relatively moving elements, and the outboard bearing and the orbiting compression member base are a second pair of relatively moving elements. An Oldham coupling is reciprocatively engaged with each relatively moving element of one of the first and second pairs of relatively moving elements, rotation of the orbiting compression member being prevented by the Oldham coupling.

BRIEF DESCRIPTION OF THE DRAWINGS

The abovementioned and other features and objects of the present invention, and the manner of attaining them, will become more apparent and the invention itself will be better understood by reference to the following description of embodiments of the invention taken in conjunction with the accompanying drawings, wherein.

Figure 1:
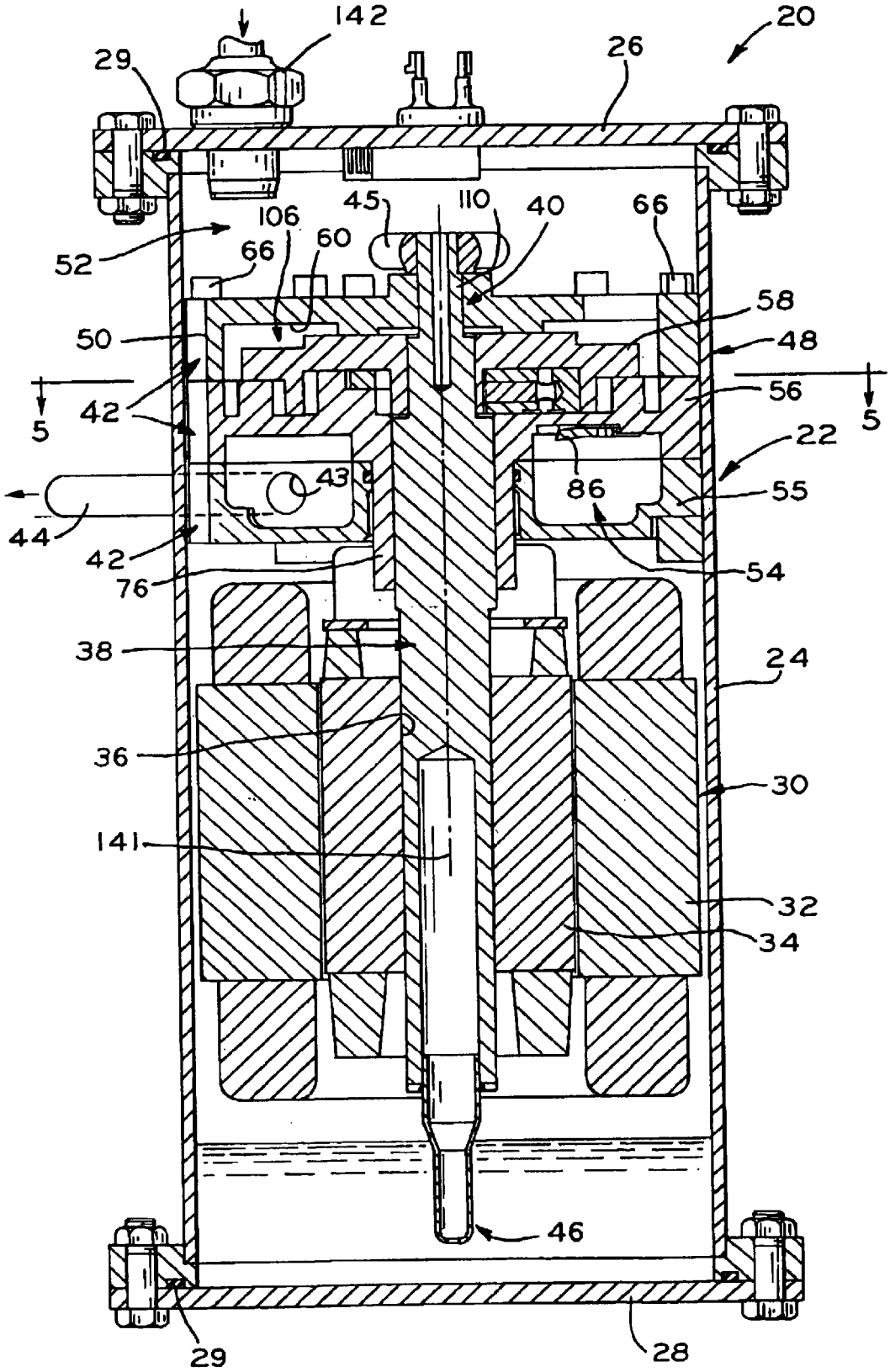
FIG. 1 is a sectional side view of a compressor assembly in accordance with a first embodiment of the present invention.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF THE INVENTION

Referring to FIG. 1, a first embodiment of orbiting rotary compressor assembly 20 includes cylindrical housing 22 having main portion 24, upper end portion 26, and lower end portion 28. Housing portions 24, 26, and 28 are bolted to one another and are hermetically sealed by any suitable method including seal 29. Those skilled in the art will recognize that housing 22 may instead comprise a plurality of formed sheet metal portions welded together as is typical. Located within housing 22 is electric motor 30 including stator 32 and rotor 34. Aperture 36 located centrally through rotor 34 receives drive shaft 38, which is interference fitted therein to rotatably fix the shaft and the rotor. Upper portion 40 of drive shaft 38 extends through compression mechanism 48 and is rotatably supported in outboard bearing 50 thereof. In the depicted embodiment, shaft 38 is vertically oriented, with compression mechanism 48 located near the top of the housing, though it is to be understood that a compressor in accordance with the present invention may be configured otherwise.

Compression mechanism 48 is disposed atop frame 55 and secured thereto by fasteners 62. Frame 55 is mounted within compressor housing 22 by any suitable method including, for example, shrink-fitting. In addition to supporting the compression mechanism and motor within the housing, frame 55 also defines, with fixed compression member 56, discharge chamber 54, which is sealably separated from the low pressure regions within the housing. As shown, compressor 20 is a low side compressor, electric motor 30 being located in a portion of housing 22 under substantially suction pressure and in communication with suction chamber 52 via passage(s) 42 formed along the outer peripheries of frame 55, fixed compression member 56 and outboard bearing 50. Those of ordinary skill in the art will recognize that, alternatively, compressor assembly 20 may be modified to form a high side compressor by, for example, eliminating passage 42 and providing an aperture in the bottom of frame 55 to place chamber 54 in fluid communication with the region of housing 22 in which motor 30 is located. Such a high side compressor may also have discharge port 43 and discharge tube 44 relocated to a position below frame 55 and be placed in communication with the motor-containing portion of the housing.

Compressor assembly 20 may be part of a refrigeration system (not shown) which includes heat exchangers, an expansion device, and refrigerant conveying lines. Compressor 20 receives refrigerant into suction chamber 52 through suction line 142 at substantially suction pressure, and discharges it from discharge chamber 54 through discharge tube 44 at substantially discharge pressure.

Compression mechanism 48 includes fixed compression member 56, orbiting compression member 58 and outboard bearing 50 which are retained together with bolts 66 which extend through clearance holes 62 in outboard bearing 50 and threaded into holes 64 of fixed compression member 56, the latter being sealably fitted to frame 55 to define discharge chamber 54. The integral, central main bearing portion of the fixed compression member, which rotatably supports shaft 38, extends through a central aperture provided in the frame, and is sealed therein with an o-ring as shown in FIG. 1. Also included in the compression mechanism are the vane(s), Oldham coupling and discharge check valve(s).

Upper portion 40 of shaft 38 extends completely through the compression mechanism, its eccentric portion 94 rotatably disposed within the hub of the orbiting compression mechanism as described further below. The shaft and the rotor fixed thereto are vertically supported within the compressor by nut 45 which is affixed in any convenient manner to end portion 110 of the shaft. Nut 45 is in turn vertically supported by outboard bearing 50. Nut 45 may also include a counterweighted portion and be fixed in a particular rotational position relative to shaft 38 to help balance rotational forces in the compressor. This subassembly is then mounted, with the stator, into the cylindrical main housing portion by a shrink fitting process well known in the art.

Figure 2:
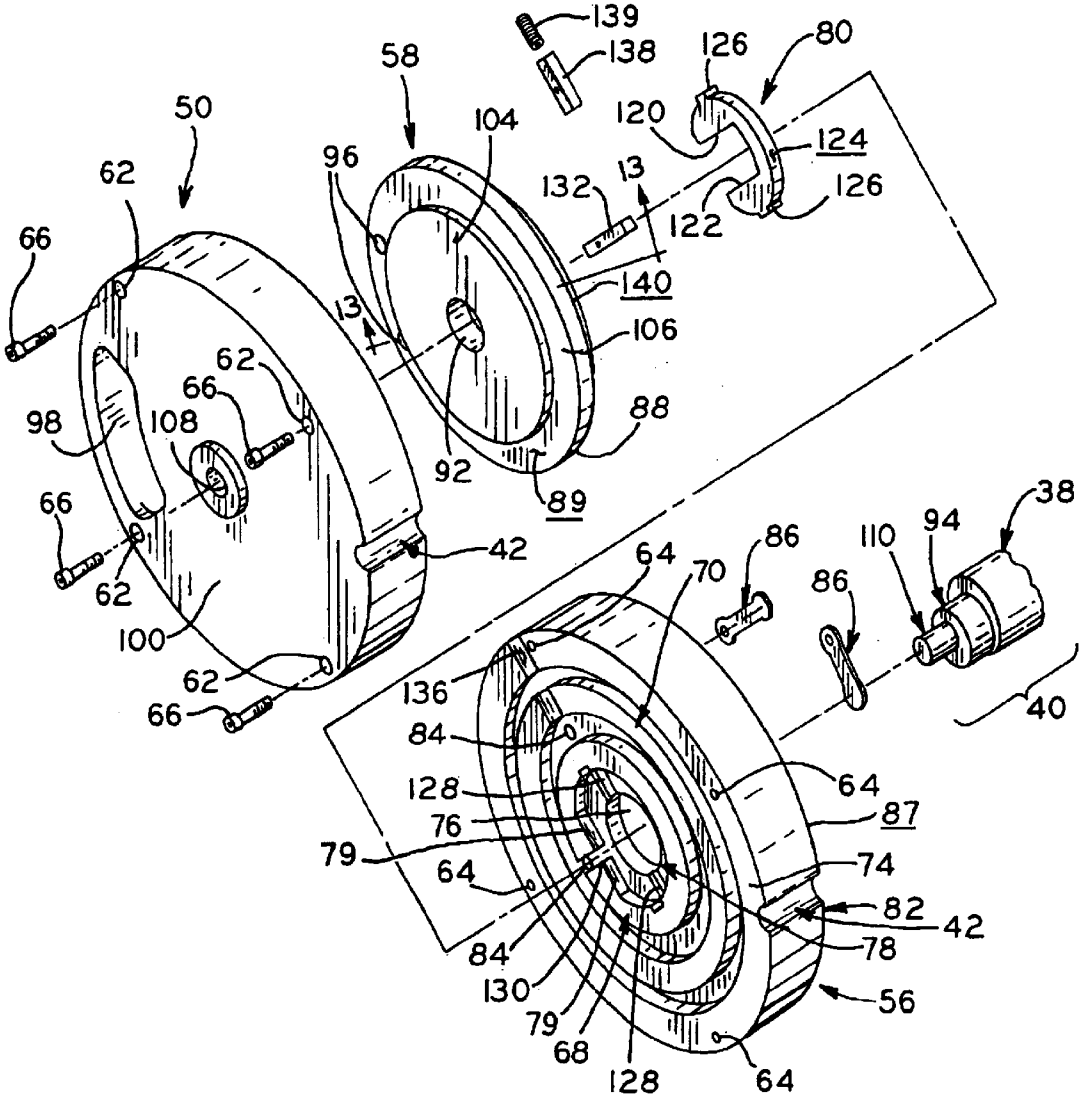
FIG. 2 is a first exploded view of the compression mechanism of the compressor assembly of FIG. 1.
Figure 3:
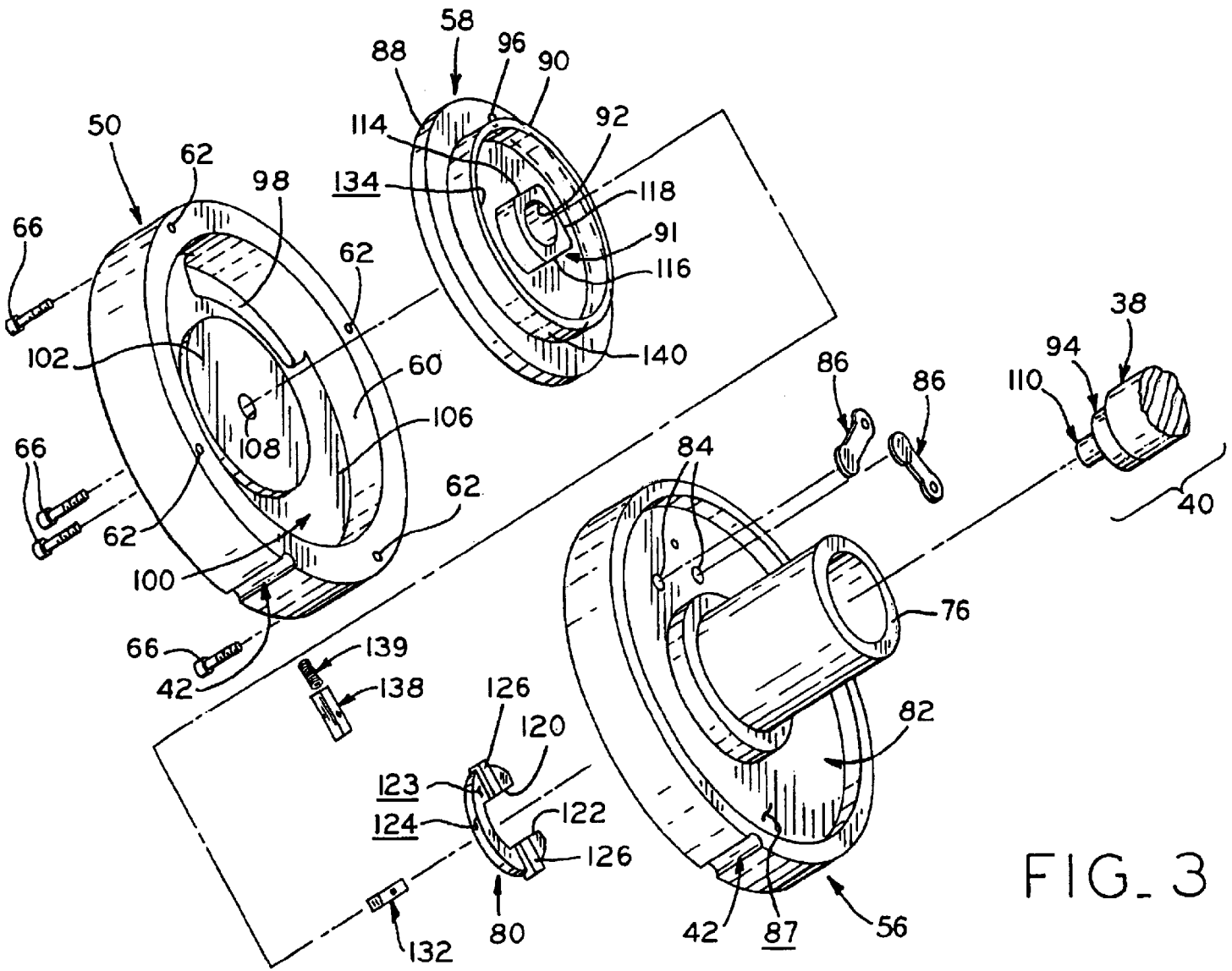
FIG. 3 is a second exploded view of the compression mechanism of FIG. 2.
Figure 4:
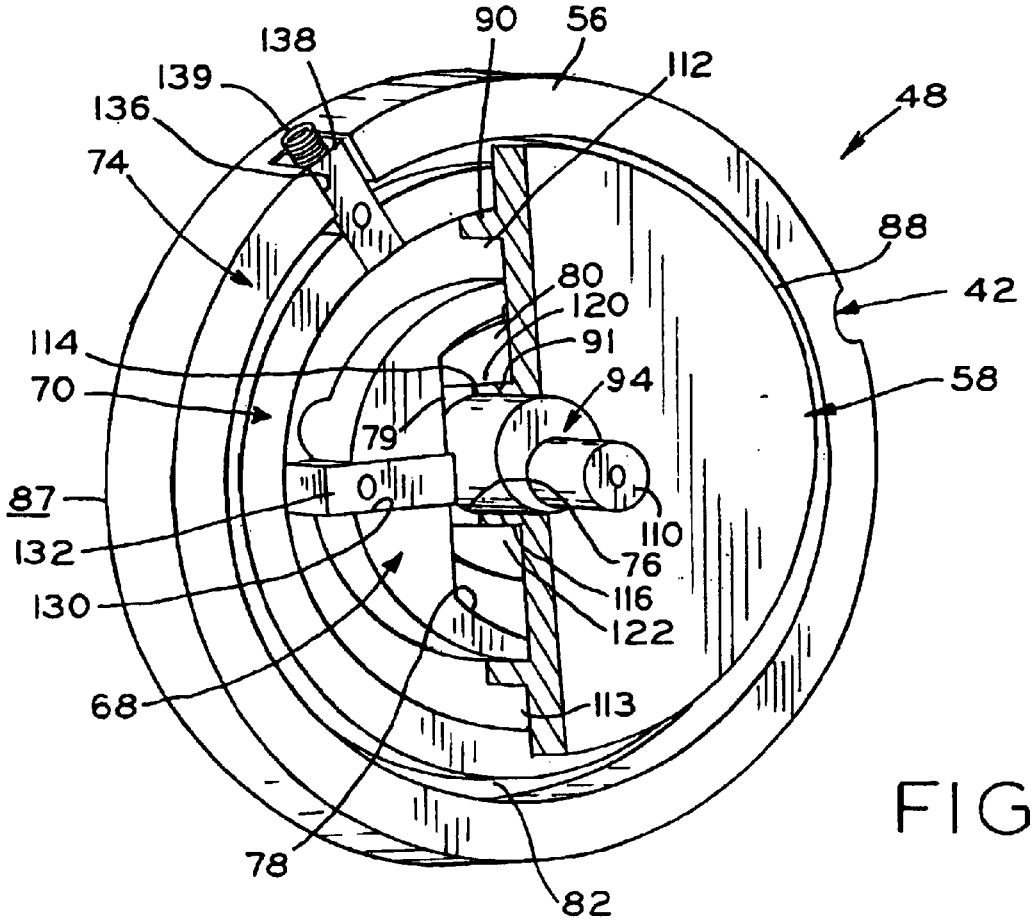
FIG. 4 is a partially sectioned, perspective view of the compression mechanism of FIGS. 2 and 3, assembled.

Referring to FIGS. 2–4, fixed compression member 56 includes integrally formed planar base portion 82, and concentric inner and outer cylindrical portions 68 and 70 extending perpendicularly from the base. Portions 68 and 70 are illustrated as being concentrically cylindrical, but may instead be of any suitable shape to accommodate sealing epicyclical engagement with the orbiting compression member. Outer race 74 is disposed about outer cylindrical portion 70, adjacent the periphery of fixed compression member base 82, and has holes 64 located therein to threadedly receive fasteners 66. Located centrally in fixed compression member 56 is main bearing portion 76 through which upper portion 40 of shaft 38 extends and in which the shaft is rotatably supported. Shaft upper portion 40 includes eccentric portion 94 which is disposed within hub 91 of orbiting compression member 58 to drive the orbiting motion of member 58 as drive shaft 38 rotates. Defined within inner cylindrical portion 68 of fixed compression member 56 is partially cylindrical or somewhat D-shaped cavity 78 having flat wall surface 79, and in which is received Oldham coupling 80. Centrally located along flat wall surface 79 is first vane slot 130 which extends through fixed compression member inner cylindrical portion 68 and receives reciprocating vane 132. Second vane slot 136 is formed through fixed compression member outer cylindrical portion 70 and outer race 74, and receives reciprocating vane 138. Vanes 132 and 138 are circumferentially offset from one another, and reciprocate along lines separated by an angle θ, which may be approximately 30 degrees (FIGS. 5–10). Angle θ defines a region between these two lines within compression mechanism 48.

Located in fixed compression member base 82 are discharge ports 84 (FIG. 3), each of which is provided with a discharge valve 86 to prevent reverse flow of compressed refrigerant from discharge chamber 54 into the compression chambers. Each valve 86 is secured to back surface 87 of base 82 by any suitable means such as by a fastener.

Orbiting compression member 58 includes integral base 88, cylindrical portion 90, and hub 91 disposed within fixed compression member cavity 78. Orbiting compression member portion 90 is illustrated as having concentrically cylindrical surfaces, but may instead be of any suitable shape to accommodate sealing epicyclical engagement with the respective interfacing surface of the fixed compression member. Hole 92 located through hub 91 rotatably receives eccentric portion 94 of shaft 38. The periphery of orbiting compression member hub 91 is provided with opposite flat surfaces 114 and 116, and flat surface 118 located therebetween (FIGS. 4–10). Orbiting compression member hub flat surface 118 superposes fixed compression member cavity flat surface 79.

Figures 11, 13:
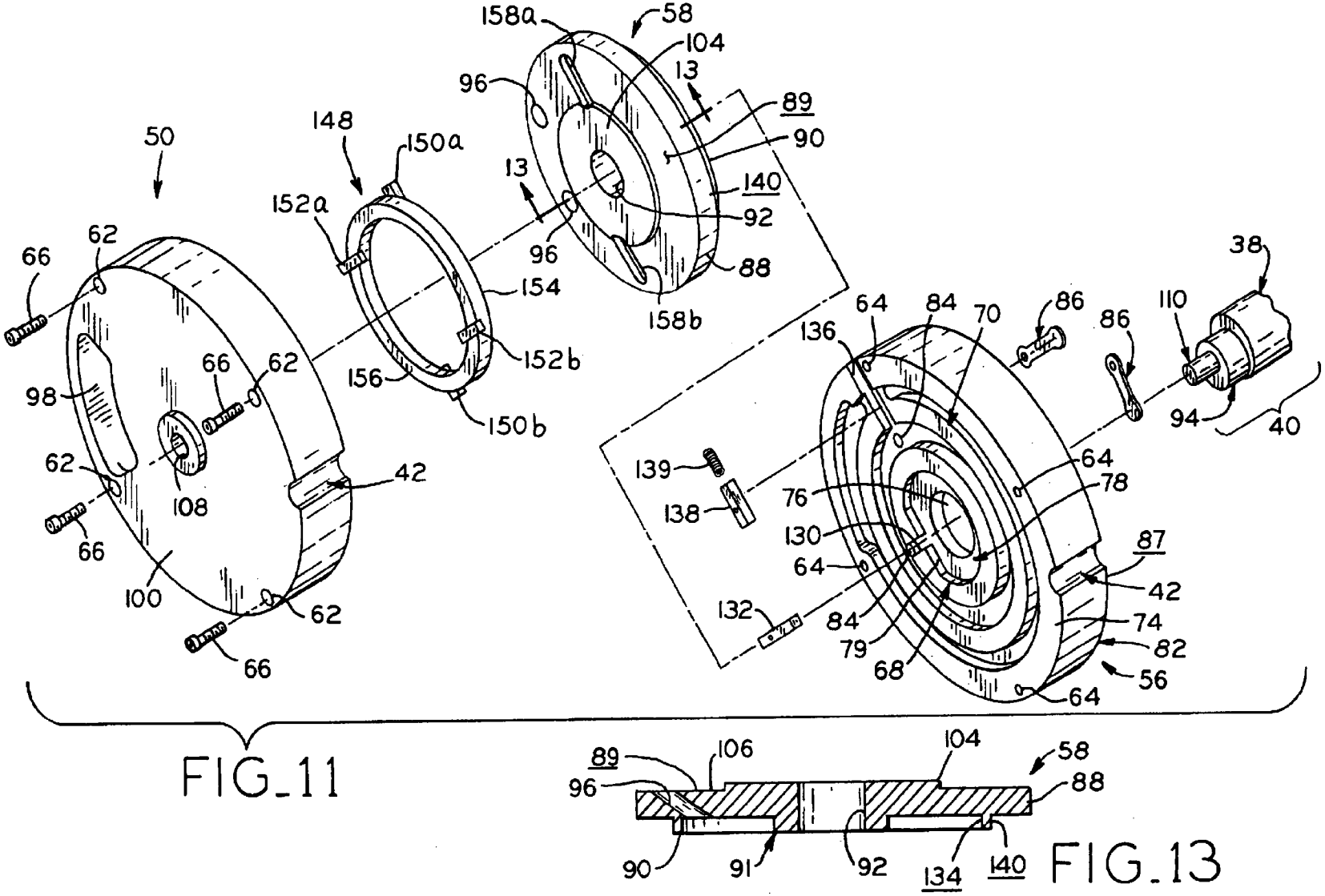
FIG. 11 is a first exploded view of the compression mechanism of a compressor assembly in accordance with a second embodiment of the present invention.
FIG. 13 is a sectional view of the orbiting compression members shown in FIGS. 2 and 11 along line 13—13.

Located on each radial side of orbiting compression member cylindrical portion 90 is the outlet of a suction port 96 which extends through orbiting compression member base 88. The inlets to the two suction ports are both located in flat annular surface 89 near the peripheral edge of orbiting compression member 58, and the suction ports are inclined as needed relative to the plane in which base 88 lies to provide suction passages which are straight between their respective inlets and outlets, as best shown in FIG. 13, to more smoothly direct refrigerant fluid into the respective inner or outer compression chamber 112, 113, as described further hereinbelow.

Orbiting compression member 58 is captured between fixed compression member 56 and outboard bearing 50. The interior of outboard bearing 50 is provided with cavity 60 in which orbiting member 58 is disposed, defined in part by substantially planar base 100 which has centrally-disposed planar raised portion 102 within the cavity. Outboard bearing raised portion 102 slidably engages planar raised portion 104 formed centrally on orbiting compression member base 88. Those of ordinary skill in the art will recognize that the surfaces of interfacing raised portions 102 and 104 need not be in direct sliding contact, but rather may be provided with a suitable thrust bearing therebetween. The annular area surrounding the edges of raised portions 102 and 104 within outboard bearing cavity 60 defines suction pressure fluid channel 106 which is in direct fluid communication with the inlets of suction ports 96. Located in the planar base of outboard bearing 50 over the inlets of suction ports 96, regardless of the ports' varying position due to orbiting motion of orbiting compression member 58, is oblong aperture 98 which places suction pressure fluid channel 106 in direct fluid communication with suction chamber 52. From channel 106, the suction pressure gas enters compression mechanism 48 via suction ports 96. Those of ordinary skill in the art will appreciate that the inlets to suction ports 96 being located or framed within the periphery of oblong aperture 98, regardless of orbiting compression member position, facilitates suction pressure gas being more readily available to the compression chambers than having the inlets to the suction ports located elsewhere in channel 106.

Referring to FIGS. 4–10, orbiting compression member cylindrical portion 90 is received between fixed compression member inner and outer cylindrical portions 68 and 70 to define inner and outer compression chambers 112 and 113. First vane 132 slidably engages the sides of first vane slot 130 formed in inner cylindrical portion 68 of fixed member 56 to reciprocate in the slot, but is fixed relative to the orbiting compression member. Vane 132 extends between and abuts flat surface 118 formed in orbiting compression member hub 91 and cylindrical inner surface 134 of orbiting compression member cylindrical portion 90, and acts to divide inner compression chamber 112 into sub-chambers 112*a* and 112*b*. Because first vane 132 is fixed between surfaces 118 and 134, and is in sealing contact with surface 134, it need not be biased with a spring into engagement with that surface, thereby providing the above-discussed advantage of eliminating vane-biasing springs where possible. Second vane 138 slidably engages the sides of second slot 136 formed in fixed compression member outer cylindrical portion 70 and outer race 74, and acts to divides outer compression chamber 113 into sub-chambers 113*a* and 113*b*. Second vane is biased into contact with the cylindrical outer surface 140 of orbiting compression member portion 90 with an elastic media such as spring 139 located between the radially outward end of vane 138 and inner cylindrical surface 27 of main housing portion 24, which is shrink-fitted about the outer periphery of the fixed compression member.

In first embodiment compression mechanism 48 of compressor 20, C-shaped Oldham coupling 80 having a substantially circular outer periphery is disposed within chamber 78 of fixed compression member 56 and engages the fixed compression member and orbiting compression member 58 to prevent rotation of the orbiting compression member with shaft 38. Flat surfaces 114 and 116 provided on orbiting compression member hub 91 are slidably engaged by respectively interfacing flat surfaces 120 and 122 of Oldham coupling 80, as best shown in FIGS. 5–10. As shown, lower axial surface 123 (FIG. 3) of the Oldham coupling interfaces the axial surface of the fixed compression member which partially defines cavity 78. Extending downwardly from axial surface 123 and radially outwardly from peripheral surface 124 of the Oldham coupling are a pair of elongate keys or protuberances 126 which are slidably engaged within elongate recesses or keyways 128 formed in the adjacent surfaces of fixed compression member 56. Oldham coupling 80 thus slidably reciprocates relative to the orbiting compression member along the interfaces of surfaces 114 and 120, and 116 and 122, and slidably reciprocates relative to the fixed orbiting compression member along the longitudinal axes of engaged keys 126 and keyways 128. The hub of the orbiting compression member and the fixed compression member thus provide a pair of relatively moving elements, each of which is in reciprocative engagement with the Oldham coupling to prevent rotation of the orbiting compression member. With Oldham coupling 80 so engaging fixed compression member 56 and orbiting compression member 58, their relative movement, and that the compressor vanes, are as depicted in FIGS. 5–10, with inner and outer compression chambers 112 and 113, and their respective sub-chambers 112*a* and 112*b* and 113*a* and 113*b*, successively varying as there shown.

In operation, motor 30 rotatably drives drive shaft 38 in a clockwise direction as seen in FIGS. 5–10, which in turn causes movement of orbiting compression member 58 via the engagement of orbiting compression member hub 91 and eccentric portion 94. As orbiting member 58 revolves about drive shaft axis of rotation 141 (FIG. 1), Oldham coupling 80 oscillates linearly back and forth relative to each of the orbiting and fixed compression members, limiting the orbiting compression member to an orbiting movement within the fixed compression member about the shaft axis of rotation. The relatively-moving cylindrical surfaces respectively defining inner and outer compression chambers 112, 113 are maintained in sealing, substantially line-to-line contact during movement of the orbiting compression member, and vanes 132 and 138 are maintained in contact with its cylindrical portion 90 to define sub-chambers 112*a*, 112*b*, 113*a* and 113*b* as described above. Via suction tube 142, refrigerant gas at suction pressure is drawn from outside housing 22 into suction pressure chamber 52 as well as into the motor-containing portion of the housing. From suction chamber 52, the suction gas passes through suction opening 98 into suction pressure fluid channel 106 located between outboard bearing 50 and orbiting compression member 58. From suction pressure channel 106, the suction pressure refrigerant gas is drawn into compression chambers 112 and 113 through suction ports 96 in orbiting compression member 58. As noted above, suction ports 96 are provided in the base of orbiting compression member 58, which is not included in the views shown in FIGS. 5–10. The locations of the suction port outlets, however, are shown in ghosted lines in these drawings.

As orbiting compression member 58 moves relative to fixed compression member 56, the volume of inner compression chamber 112 remains substantially constant while the volumes of its sub-compression chambers 112*a*, 112*b* vary. Notably, when first vane 132 is fully contracted into its slot 130, and orbiting compression member cylindrical surface 134 is at its closest position to the radially outward opening of slot 130, sub-chambers 112*a* and 112*b* are temporarily nonexistent, and the inner compression chamber is defined by a singular crescent-shaped volume. Notably, the outlet of suction port 96 for inner compression chamber 112, located within the region defined by angle θ, is substantially closed near this position (FIGS. 7–9), being covered and blocked by the interfacing axial surface of fixed compression member inner cylindrical portion 68. Each sub-chamber 112*a*, 112*b* alternatingly receives gas substantially at suction pressure through the outlet of suction port 96, and gas compressed in a sub-chamber 112*a* or 112*b* is discharged into discharge chamber 54 from inner compression chamber 112 through its discharge port 84, located in the base of the fixed compression member adjacent to first vane 132 and outside the region defined by angle θ.

Similarly, as orbiting compression member 58 moves relative to fixed compression member 56, the volume of outer compression chamber 113 remains substantially constant while the volumes of its sub-compression chambers 113*a*, 113*b* vary. Notably, when second vane 138 is fully contracted into its slot 136, and orbiting compression member cylindrical surface 140 is at its closest position to the radially inward opening of slot 138, sub-chambers 113*a* and 113*b* are temporarily nonexistent, and the outer compression chamber is defined by a singular crescent-shaped volume. Notably, the outlet of suction port 96 for outer compression chamber 113, located outside the region defined by angle θ, is substantially closed near this position (FIGS. 5–7), being covered and blocked by the interfacing axial surface of fixed compression member outer cylindrical portion 70. Each sub-chamber 113*a*, 113*b* alternatingly receives gas substantially at suction pressure through the outlet of suction port 96, and gas compressed in a sub-chamber 113*a* or 113*b* is discharged into discharge chamber 54 from outer compression chamber 113 through its discharge port 84, located in the base of the fixed compression member adjacent to vane 138 and within the region defined by angle θ.

Figure 5:
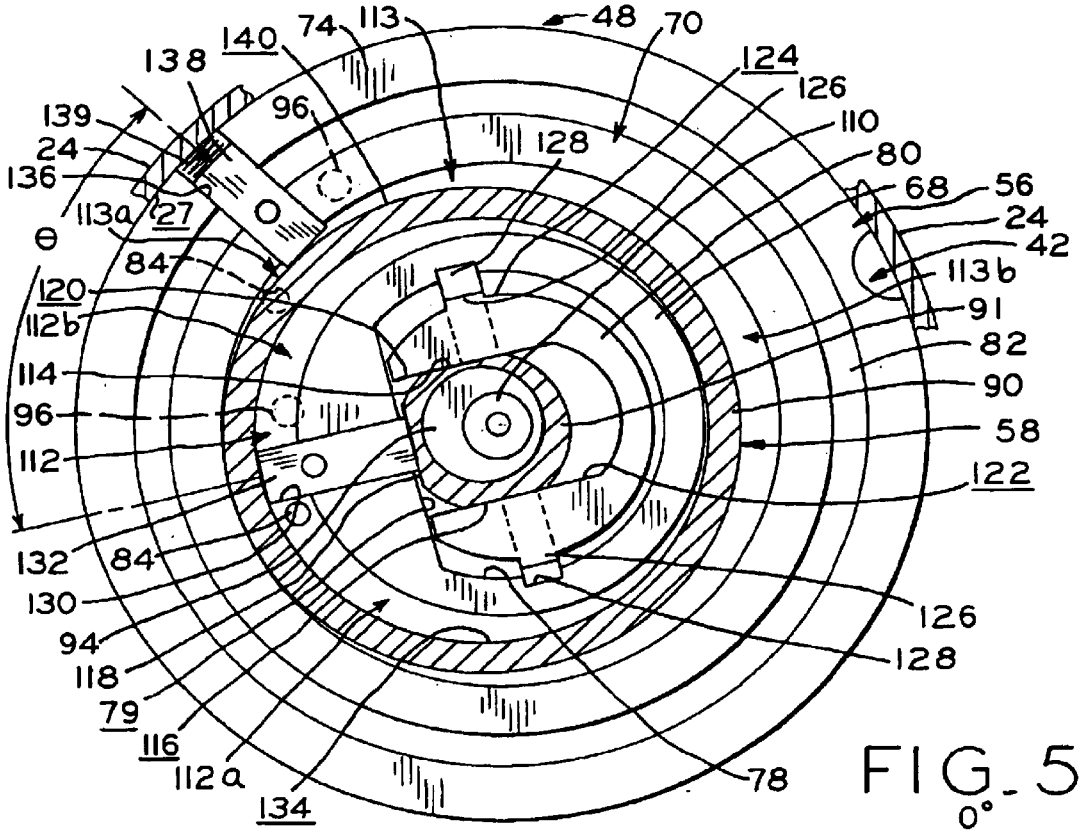
FIG. 5 is a sectional view of the compressor of FIG. 1 along line 5—5 at a zero degree position.

In the position shown in FIG. 5, in which the rotational position of drive shaft 38 is arbitrarily defined as being the zero degree position, first vane 132 extends over the radially widest portion of inner compression chamber 112, and is nearly fully extended from first vane slot 130. In this position, the volumes of sub-chambers 112*a* and 112*b* are substantially equal, with the gas in chamber 112*a* being compressed and chamber 112*b* being filled with suction pressure gas. In this position, second vane 138 is nearly fully contracted into second vane slot 136, forced thereinto by radially outer surface 140 of orbiting compression member 58 cylindrical portion 90. Here, volume of sub-chamber 113*a* is relatively small as the compressed gas is nearly completely discharged therefrom, and the axial face of orbiting compression member cylindrical portion 90 nearly completely covers and blocks discharge port 84 of outer compression chamber 113. Sub-chamber 113*b* comprises nearly the entire volume of compression chamber 113, and contains gas at substantially suction pressure.

Figure 6:
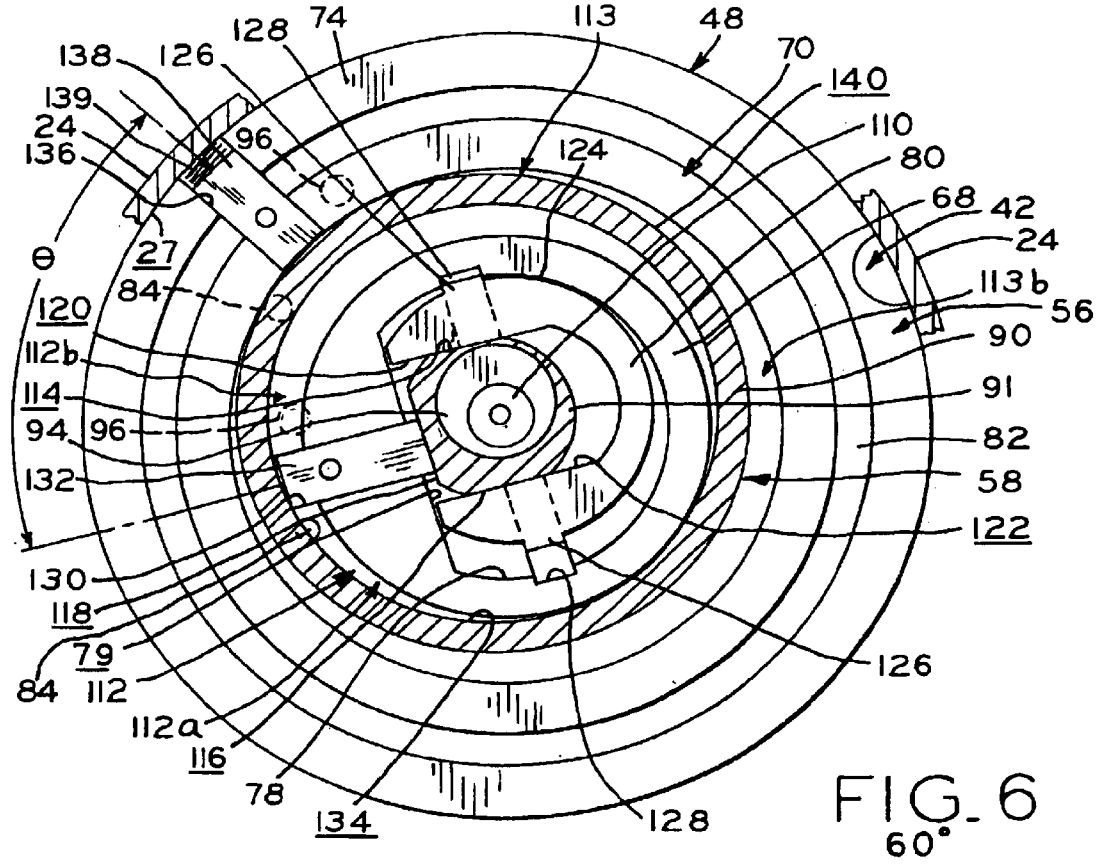
FIG. 6 is a sectional view of the compressor of FIG. 1 along line 5—5 at a 60 degree position.

FIG. 6 shows compression mechanism 48 after drive shaft 38 has rotated in the clockwise direction approximately 60 degrees. Here, the volume of sub-chamber 113*a* is reduced to zero, with the compressed gas being completely expelled therefrom, and sub-chamber 113*b* comprises the entire volume of outer compression chamber 113 and contains refrigerant at substantially suction pressure. The axial face of orbiting compression member cylindrical portion 90 completely covers and blocks discharge port 84 of outer compression chamber 113. The volume of sub-chamber 112*a* is reduced relative to that shown in FIG. 5, the gas being further compressed and expelled through discharge port 84 of inner compression chamber 112. The volume of sub-chamber 112*b* is increased relative to that shown in FIG. 5, and continues to draw in refrigerant at substantially suction pressure.

Figure 7:
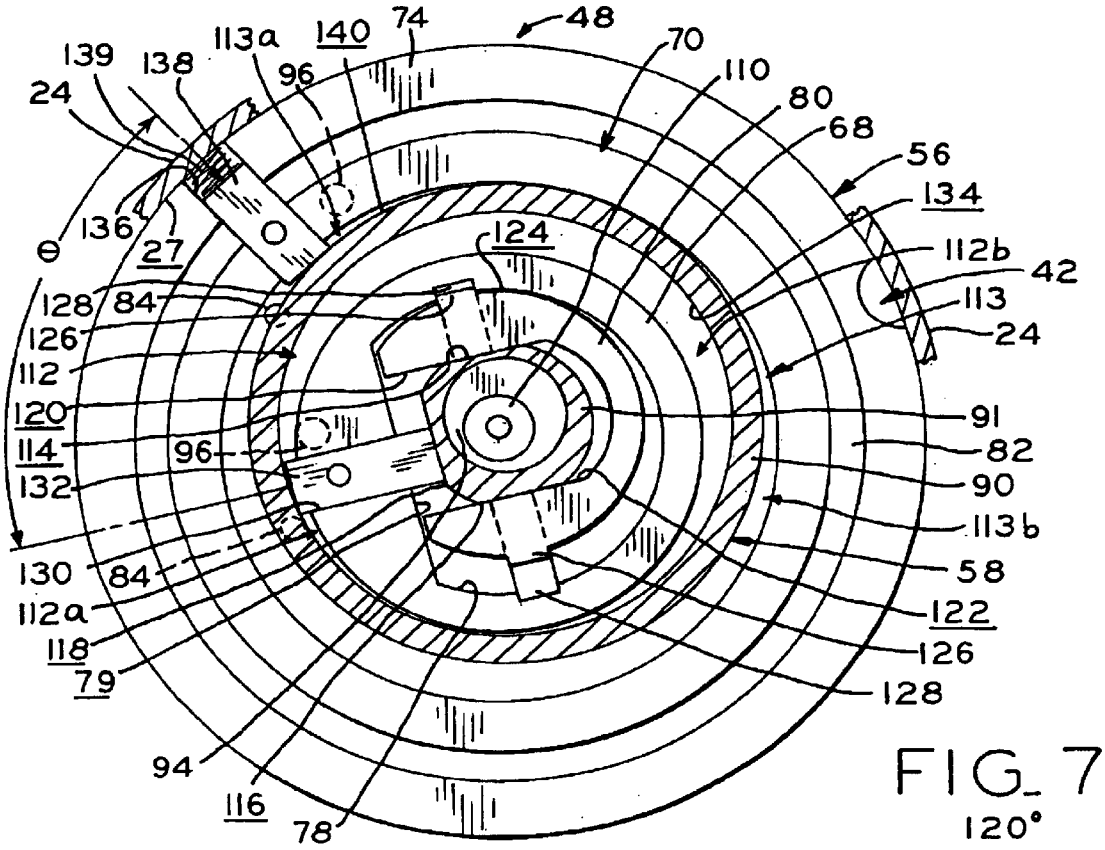
FIG. 7 is a sectional view of the compressor of FIG. 1 along line 5—5 at a 120 degree position.

Referring to FIG. 7, as drive shaft 38 continues to rotate to approximately 120° the refrigerant in sub-chamber 112*b* is compressed toward discharge pressure, the axial face of fixed compression member inner cylindrical portion 68 covers and blocks the outlet of suction port 96 in inner compression chamber 112. The remainder of compressed gas in sub-chamber 112*a* is expelled through discharge port 84 into discharge chamber 54, and discharge port 84 of inner compression chamber 112 is nearly completely covered and blocked by the axial face of orbiting compression member cylindrical portion 90.

Figure 8:
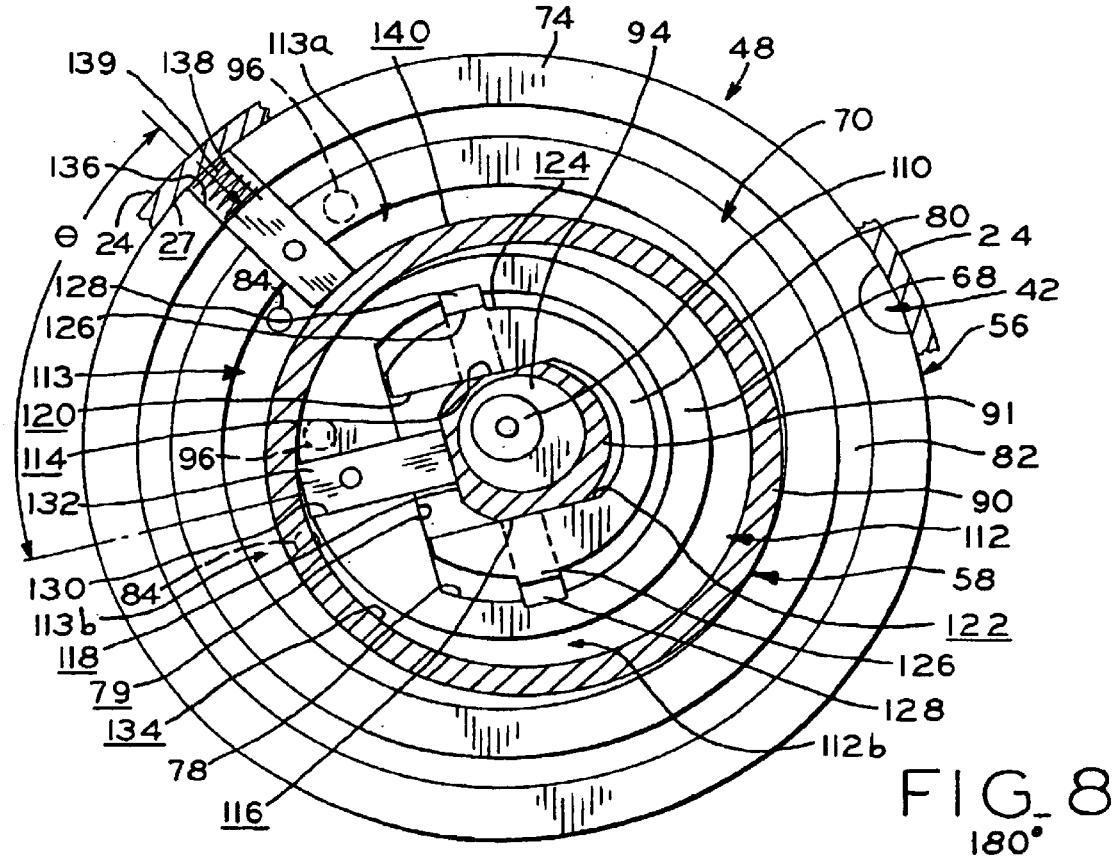
FIG. 8 is a sectional view of the compressor of FIG. 1 along line 5—5 at a 180 degree position.
Figure 9:
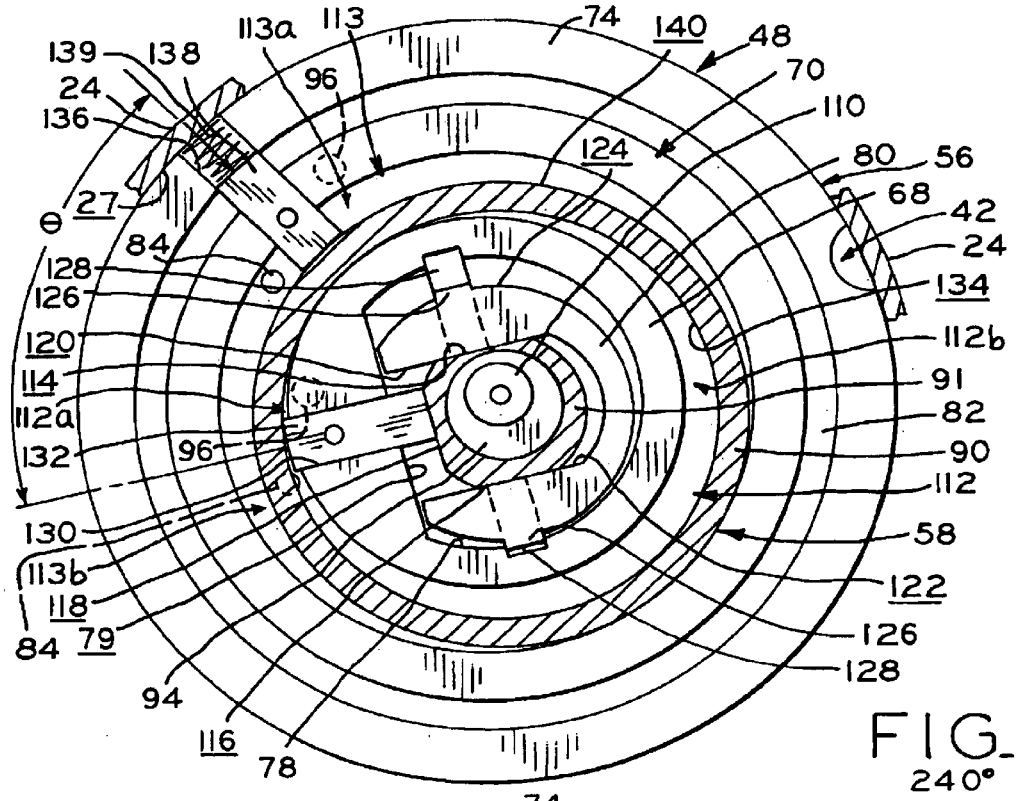
FIG. 9 is a sectional view of the compressor of FIG. 1 along line 5—5 at a 240 degree position.
Figure 10:
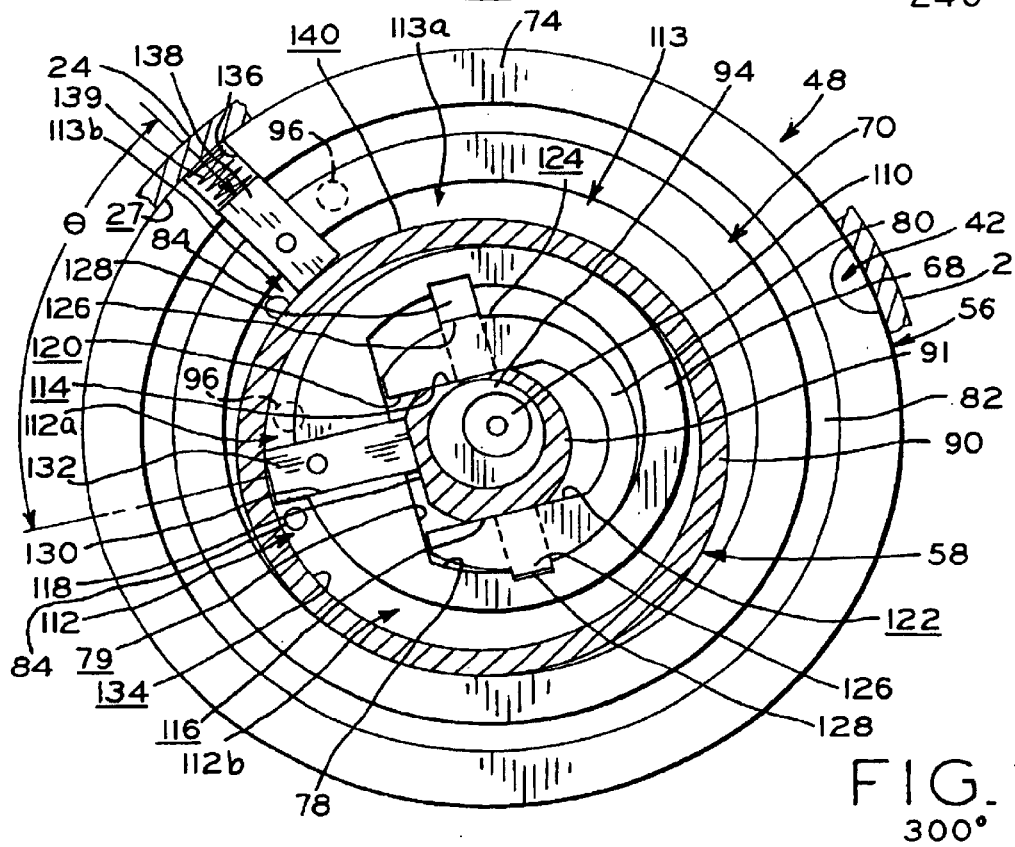
FIG. 10 is a sectional view of the compressor of FIG. 1 along line 5—5 at a 300 degree position.

Those of ordinary skill in the art will now understand, with reference to FIGS. 8–10 the cyclic manner in which gas is drawn into and compressed within compression chambers 112 and 113. The discharge pressure refrigerant gas expelled from the compression chambers into discharge chamber 54 is forced from compressor assembly 20 via discharge port 43 provided in frame 55 and discharge tube 44 sealably fitted therein (FIG. 1), and returned to the refrigeration system.

Compressor 20 having second embodiment compression mechanism 48 is modified to be provided with annular Oldham coupling 148 in lieu of C-shaped Oldham coupling 80. Oldham coupling 148 is disposed between and engages the base of orbiting compression member 58 and outboard bearing 50 to prevent rotation of the orbiting compression member relative to fixed compression member 56. Compressor assembly 20 is otherwise structurally and functionally identical to that described above.

Figure 12:
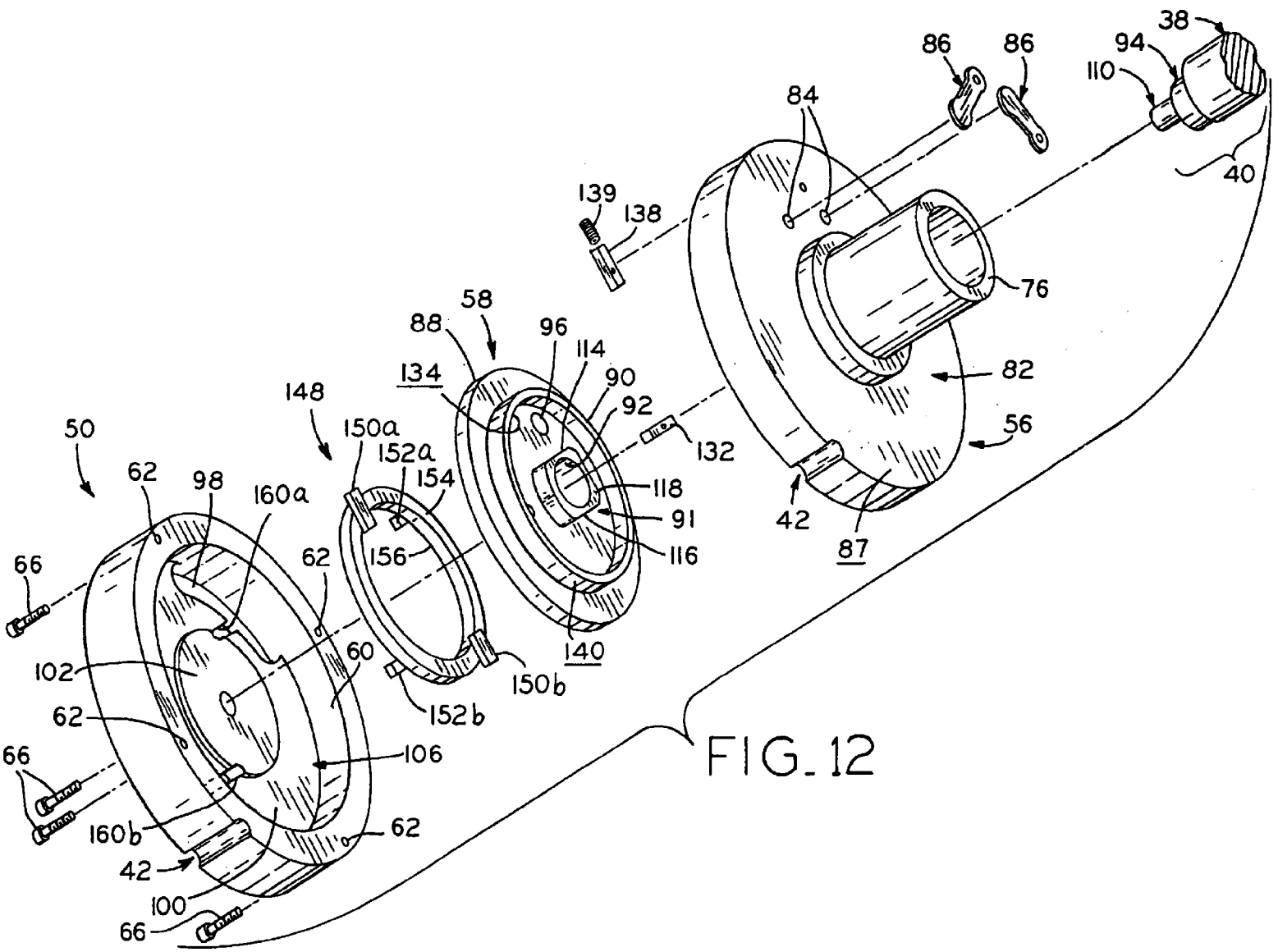
FIG. 12 is a second exploded view of the compression mechanism of FIG. 11.

Referring to FIGS. 11 and 12, Oldham coupling 148 has integrally-formed first and second pairs of keys 150*a*, 150*b* and 152*a*, 152*b* located on opposite axial sides 154, 156 of its annular body. Keys 150*a* and 150*b* are positioned on side 154 approximately 180° from one another with their longitudinal axes being offset and substantially parallel. Similarly, keys 152*a* and 152*b* are positioned on side 156 approximately 180° from one another with their longitudinal axes being offset and substantially parallel, and perpendicular to the longitudinal axes of keys 150*a* and 150*b*.

Keys 150*a*, 150*b* and 152*a*, 152*b* are received in slot-like keyways formed in orbiting member 58 and outboard bearing 50, respectively. Referring to FIG. 11, keyways 158*a* and 158*b* are formed in planar surface 89 of orbiting compression member base plate 88 to receive keys 150*a* and 150*b*. Referring to FIG. 12, the interior surface of outboard bearing planar base 100 is provided with keyways 160*a* and 160*b* for receiving keys 152*a* and 152*b*.

The annular body of Oldham coupling 148 is located in annular fluid passage 106, and surrounds with clearance the respective raised portions 102 and 104 of the outboard bearing and orbiting compression member, which may slidably abut or be provided with a thrust bearing therebetween as described above. As is typical, the keys of Oldham coupling 148 move linearly within the keyways in which they are disposed, keys 150*a* and 150*b* slidably engaging keyways 158*a* and 158*b*, and keys 152*a* and 152*b* slidably engaging keyways 160*a* and 160*b*. The outboard bearing and the base of the orbiting compression member thus provide a pair of relatively moving elements, each of which is in reciprocative engagement with the Oldham coupling to prevent rotation of the orbiting compression member. With Oldham coupling 148 so engaging outboard bearing 50 and orbiting compression member 58, their relative movement, and that of the compressor vanes, are again as depicted in FIGS. 5–10, with inner and outer compression chambers 112 and 113, and their respective sub-chambers 112*a* and 112*b* and 113*a* and 113*b*, successively varying as there shown.

The above described embodiments of compressor 20 are examples of twin orbiting rotary compressors, each having two separate compression chambers. Those of ordinary skill in the art will appreciate, however, that with only minor modifications to what is herein disclosed, the present invention may also conveniently provide an orbiting rotary compressor having only a single compression chamber. For example, outer compression chamber 113 may be omitted by eliminating its pair of discharge and suction ports 84, 96 and spring-biased vane 138, thereby providing an orbiting rotary compressor having a single compression chamber 112 and fixed vane 132 as described above.

While this invention has been described as having exemplary designs, the present invention may be further modified within the spirit and scope of this disclosure. This application is therefore intended to cover any variations, uses, or adaptations of the invention using its general principles. For example, the present invention may include a multi-stage compressor rather than a single-stage, multi-compression chamber compressor as discussed herein above. Such a multi-stage compressor may, for example, further compress the fluid compressed in and discharged from inner compression chamber 112 in outer compression chamber 113, from which it would then be discharged from compressor assembly 20, or vice versa. Further, this application is intended to cover such departures from the present disclosure as come within known or customary practice in the art to which this invention pertains.

What is claimed is:

1. An orbiting rotary compressor assembly comprising:

a compressor housing;

a compression mechanism disposed in said housing and including relatively moving fixed and orbiting compression members, said compression members having extending portions having surfaces engaged with each other and between which a compression chamber is located, said orbiting member further having a centrally-located hub;

a rotating drive shaft having an axis of rotation and in driving engagement with said orbiting compression member hub, said hub having eccentric movement relative to said axis of rotation;

a vane operatively engaging said fixed member extending portion and said orbiting member extending portion, said compression chamber being partially defined by said vane; and an Oldham coupling disposed about and in engagement with said hub, said Oldham coupling also being in engagement with said fixed compression member, rotation of said orbiting compression member being prevented by said Oldham coupling.

2. The compressor assembly of claim 1, wherein said drive shaft has an eccentric portion which extends through said orbiting compression member hub, and said compression mechanism further comprises a stationary outboard bearing, said drive shaft being supported by said outboard bearing, said orbiting member disposed between said fixed member and said outboard bearing.

3. The compressor assembly of claim 2, wherein said orbiting member has a base from which said orbiting compression member extending portion extends, at least one suction port through which gas at substantially suction pressure enters said compression chamber being provided through said orbiting compression member base, said outboard bearing having a base superposing said orbiting compression member base, said outboard bearing base being provided with an opening having a periphery within which said suction port is framed, gas at substantially suction pressure entering said suction port first being flowed through said outboard bearing opening.

4. The compressor assembly of claim 1, wherein said fixed compression member is provided with a discharge port through which gas compressed in said compression chamber exits said compression mechanism.

5. The compressor assembly of claim 4, further comprising a frame supported in said housing and to which said compression mechanism is connected, said fixed compression member and said frame defining a discharge chamber in fluid communication with said compression chamber via said discharge chamber, gas at substantially discharge pressure exiting said compressor assembly from said discharge chamber.

6. The compressor assembly of claim 5, wherein said discharge chamber is sealably separated from and partially surrounded by suction pressure regions within said housing.

7. The compressor assembly of claim 1, wherein said vane is stationary relative to said orbiting compression member, and extends between said orbiting compression member extending portion surface and said hub, and said fixed compression member is provided with a slot in which said vane reciprocates.

8. The compressor assembly of claim 1, wherein said fixed compression member extending portion is a fixed compression member first extending portion, said orbiting compression member extending portion surface is an orbiting compression member extending portion first surface, said vane is a first vane, said compression chamber is a first compression chamber, and said orbiting compression member extending portion has a second surface, and further comprising a fixed compression member second extending portion having a surface which surrounds said orbiting compression member extending portion second surface, a second compression chamber being located between said fixed compression member second extending portion surface and said orbiting compression member extending portion second surface, and a second vane operatively engaging said fixed compression member second extending portion and said orbiting member extending portion, said second compression chamber being partially defined by said second vane.

9. The compressor assembly of claim 8, wherein said second vane is biased into engagement with said orbiting compression member extending portion second surface, and said fixed compression member is provided with a slot in which said second vane reciprocates.

10. The compressor assembly of claim 9, wherein said first and second compression chambers are each provided with a suction port and a discharge port through which suction gas enters said compression mechanism and discharge gas exits said compression mechanism.

11. The compressor assembly of claim 10, wherein said orbiting compression member has a substantially planar base from which its said extending portion extends, said suction ports being located in said orbiting compression member base, said suction ports having their respective outlets located on opposite sides of said orbiting compression member extending portion.

12. The compressor assembly of claim 10, wherein said orbiting compression member has a substantially planar base from which its said extending portion extends, said suction ports being located in said orbiting compression member base, and further comprising a stationary outboard bearing having a base superposing said orbiting compression member base, said outboard bearing base being provided with an opening having a periphery within which said suction ports are both framed, gas at substantially suction pressure entering said suction ports first being flowed through said outboard bearing opening.

13. The compressor assembly of claim 1, wherein substantially parallel surfaces are provided on opposite radial sides of said hub and said Oldham coupling is provided with a pair of keys and substantially parallel opposed surfaces which are in sliding reciprocating engagement with said hub surfaces, said Oldham coupling thereby having a fixed rotational position relative to said orbiting compression member, said fixed compression member is provided with a pair of elongate slots in which said keys are slidably engaged, said Oldham coupling thereby having a fixed rotational position relative to said fixed compression member.

14. The compressor assembly of claim 13, wherein said Oldham coupling is substantially C-shaped, said vane engaging said hub at a location between said Oldham coupling substantially parallel opposed surfaces.

15. The compressor assembly of claim 14, wherein said vane is fixed relative to said orbiting compression member, and extends between said hub and said orbiting compression member extending portion surface.

16. An orbiting rotary compressor assembly comprising:

a compressor housing;

a compression mechanism disposed in said housing and including relatively moving fixed and orbiting compression members, and an outboard bearing fixed to said fixed compression member and which supports said orbiting compression member, said compression members each having a base from which an extending portion extends, said fixed and orbiting compression member extending portions having surfaces engaged with each other and between which a compression chamber is located, said orbiting member further having a centrally-located hub extending from its said base, said hub and said fixed compression member being a first pair of relatively moving elements, said outboard bearing and said orbiting compression member base being a second pair of relatively moving elements;

a rotating drive shaft having an axis of rotation and in driving engagement with said orbiting compression member hub, said hub having eccentric movement relative to said axis of rotation;

a vane operatively engaging said fixed member extending portion and said orbiting member extending portion, said compression chamber being partially defined by said vane; and an Oldham coupling reciprocatively engaged with each relatively moving element of one of said first and second pairs of relatively moving elements, rotation of said orbiting compression member being prevented by said Oldham coupling.

17. The compressor assembly of claim 16, wherein said Oldham coupling is reciprocatively engaged with said hub and said fixed compression member.

18. The compressor assembly of claim 17, wherein said hub is provided with a pair of substantially parallel surfaces, and said Oldham coupling is provided with opposed substantially parallel surfaces which respectively slidably engage said hub surfaces, said orbiting compression member and said Oldham coupling thereby being rotationally fixed together.

19. The compressor assembly of claim 18, wherein said fixed compression member is provided with slots and said Oldham coupling is provided with keys, said keys and slots being slidably engaged, said fixed compression member and said Oldham coupling thereby being rotationally fixed together.

20. The compressor assembly of claim 16, wherein said vane is fixed relative to said orbiting compression member and extends between and abuts said orbiting compression member extending portion surface and said hub.

* * * * *